US010663154B2

(12) United States Patent
DeMayo et al.

(10) Patent No.: US 10,663,154 B2
(45) Date of Patent: May 26, 2020

(54) LED STRIPS BUSSING SYSTEM AND PROCESS

(71) Applicant: LITEGEAR INC., Burbank, CA (US)

(72) Inventors: Albert DeMayo, Santa Clarita, CA (US); Alex Vazquez, Monrovia, CA (US); Sean Goossen, Sherman Oaks, CA (US)

(73) Assignee: LITEGEAR INC., Burbank, CA (US)

( * ) Notice: Subject to any disclaimer, the term of this patent is extended or adjusted under 35 U.S.C. 154(b) by 0 days.

(21) Appl. No.: 16/569,836

(22) Filed: Sep. 13, 2019

(65) Prior Publication Data

US 2020/0088392 A1 Mar. 19, 2020

Related U.S. Application Data

(60) Provisional application No. 62/731,080, filed on Sep. 13, 2018.

(51) Int. Cl.

| | |
|---|---|
| ***F21V 23/00*** | (2015.01) |
| *F21Y 103/10* | (2016.01) |
| *F21Y 113/10* | (2016.01) |
| *F21Y 115/10* | (2016.01) |

(52) U.S. Cl.

CPC ..... *F21V 23/002* (2013.01); *F21Y 2103/10* (2016.08); *F21Y 2113/10* (2016.08); *F21Y 2115/10* (2016.08)

(58) Field of Classification Search

CPC ..... F21V 23/00; F21V 23/002; F21V 23/06; F21V 21/005; F21V 21/088; F21V 19/003; H05B 45/00; H05B 45/10; H05B 45/20; H05B 45/40; H05B 45/46; H05B 45/395; H05B 47/18; F21S 4/20; F21S 4/22; F21S 4/24; F21S 4/28; F21Y 2103/10; F21Y 2115/10

See application file for complete search history.

(56) References Cited

U.S. PATENT DOCUMENTS

| | | | | |
|---|---|---|---|---|
| 9,976,711 | B2 * | 5/2018 | Simmons | F21S 4/24 |
| 10,107,464 | B2 * | 10/2018 | Hoffman | F21V 19/0055 |
| 10,194,496 | B2 * | 1/2019 | Rogers | H05B 45/20 |
| 10,499,511 | B2 * | 12/2019 | Holec | H05K 1/0269 |
| 2008/0067526 | A1 * | 3/2008 | Chew | H05K 1/189 257/88 |
| 2019/0032870 | A1 * | 1/2019 | Qiu | F21S 4/24 |
| 2019/0237506 | A1 * | 8/2019 | Isaacson | H01L 27/153 |

* cited by examiner

*Primary Examiner* — Haissa Philogene

(74) *Attorney, Agent, or Firm* — Socal IP Law Group LLP; Angelo Gaz

(57) ABSTRACT

Bussing systems for bussing strips of LEDs that do not require insulation between adjacent copper solder pads, that enable cutting of each of the LED strips without loss of functionality for the cut strips(s), and that permit a power input lead to be soldered onto each strip without incident.

8 Claims, 7 Drawing Sheets

PRIOR ART

PRIOR ART

PRIOR ART

PRIOR ART

LED STRIPS BUSSING SYSTEM AND PROCESS

CROSS REFERENCE TO RELATED APPLICATION

This application claims the benefit of and incorporates by reference U.S. provisional patent application 62/731,080, filed Sep. 13, 2018.

FIELD OF INVENTION

The invention(s) relate(s) generally to the field of lighting using light emitting diodes (LEDs), and in particular to strips of LEDs that are electrically connected together, or bussed for use in the motion picture and television fields or industries, more particularly for fabricating custom light sources, such as panels that include bussed strips, and using these light sources for illuminating various set elements as well as entire sets.

BACKGROUND

Light emitting diodes (LEDs), LED strips or tapes, (when a plurality of strips or tapes are assembled into an array, they typically are referred to as an LED strip array or as LED strip arrays) and LED strip busses for use in the motion picture and television fields are well known. However, conventional LED s trips, LED strip arrays and LED strip busses are typically constructed as shown in FIGS. 1, 2, 2A and 3, and suffer from several drawbacks or problems. Those problems include a relatively long period of time required to fabricate such conventional, bussed LED strips, personnel who fabricate such conventional must have significant experience, and significant cost of materials for fabrication of such conventional, bussed LED strips.

SUMMARY OF INVENTION

The LED systems and processes according to the present disclosure overcome the drawbacks and problems of known LED strips bussing systems by providing LED bussing systems and processes that do not require insulation between adjacent copper solder pads, that provide for the capability of permitting each of the LED strips or tapes to be cut, and permit the power input lead to be soldered on each LED tape or strip without incident.

Embodiments, examples, features, aspects, and advantages of the present disclosure will become better understood with regard to the following description, appended claims and accompanying drawings.

BRIEF DESCRIPTION OF THE DRAWINGS

The foregoing aspects and the attendant aspects of the present disclosure will become more readily appreciated by reference to the following detailed description, when taken in conjunction with the accompanying drawings.

Reference symbols or names are used in the figures to indicate certain components, aspects or features shown therein. Reference symbols common to more than one figure indicate like components, aspects or features shown therein.

DETAILED DESCRIPTION OF INVENTION

In accordance with embodiments described herein, preferred embodiments of LED light source strips and buses will be described. For the purpose of the present disclosure, the terms "bussing" and "bus" refer to electrically connecting separate LED strips in parallel so that the combined LED strips function or operate as a single LED strip, and to the physical structures that enable this function or operation. The term "bussing" also refers to or is the act of connecting LED strips with an electrically conductive material, such as solid copper wire, typically by physically connecting the strips, such as by means of soldering the electrically conductive material to each LED strip that is to be connected. Bussing requires that all like-positive and like-negative branches of an LED light strip circuit be connected together. For example, when two or more LED light source strips are connected together, each positive circuit of each strip should be electrically connected to the positive circuit(s) of each of the other strip(s). For conventional bussing techniques used with conventional LED light source strips, some insulation material, such as shown at 31, 33 in FIG. 1, must be used in order to prevent short circuits. Prevention of short circuits, but without the need for such insulation and without the labor and material costs associated with providing such insulation is an advantageous aspect of the present inventions, as shown and described below.

Figure 1:
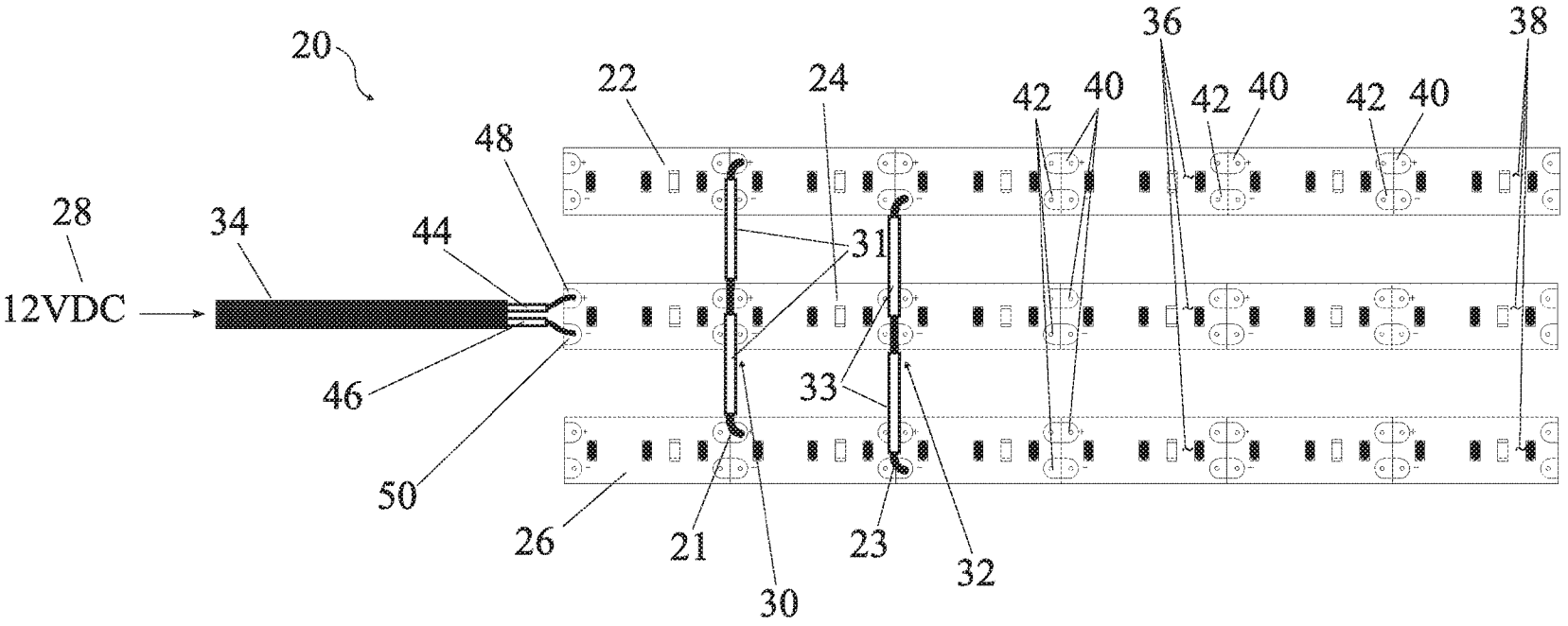
FIG. 1 is a top view of a conventional LED light source strip including three single color LED strips with conventional bussing.

Referring to FIG. 1, a conventional, LED panel bus system, alternatively referred to as a strip assembly or LED light panel 20 emits a single color of light. Assembly 20 includes, for example, three single color LED strips 22, 24 and 26. These strips have been "bussed" together with bus assemblies 30 and 32. Input power is provided by an external DC voltage power source 28, which in this embodiment is 12 VDC. The power is provided through input power lead 34, with positive DC power conductor 44 soldered or otherwise physically connected to positive solder pad 48 and with negative DC power conductor 46 soldered or otherwise physically connected to negative solder pad 50.

Solid copper wire 21, for example, a length of 18AWG solid copper, connects positive circuit solder pads, one of which is shown at 40, that are positioned on each of the three LED strips 22, 24 and 26. Wire 21 forms the basis for positive bus sub-assembly 30 as shown in FIG. 1. Optionally, other electrically conductive material may be used in place of solid copper wire 21, such as, for example, stranded copper wire, copper tape, gold wire, or any other electrically conductive material that can be insulated to prevent accidental contact with negative solder pads, one of which is shown at 42.

FIG. 1 also shows electrically conductive material or wire 23. Wire 21 is shown as connecting the positive part of the circuit and wire 23 is shown as connecting the negative part of the circuit. Wire 23 forms the basis of or is a main component of the negative bus sub-assembly 32. Second single color conventional LED strip 24 and third single color conventional LED strip 26 are also shown in FIG. 1. Positive bus sub-assembly 30 includes, solid copper wire 21 and pieces of insulation, with the insulation typically a Teflon brand fluoropolymer sleeve, two of which are shown at 31, 31 in FIG. 1. Corresponding negative bus sub-assembly 32 also includes Teflon brand fluoropolymer sleeves, shown at 33, 33 in FIG. 1. The sub-assemblies 30, 32 are soldered, or otherwise physically and electrically connected to solder pads, such as positive solder pads 40, and negative solder pads 42, respectively. For the purpose of the present disclosure of invention, the terms electrically connected and physically connected are not used to have the same meaning. However, in typical circuits, assemblies and sub-assemblies described herein, the term electrically connected typically refers to, but does not necessarily refer to structures, components, circuits or parts or branches of circuits that are physically connected.

The use of, and considerable labor associated with preparing and positioning these above-described conventional bus sub-assemblies are known to cause significant problems associated with these conventional LED light strips. For example, during the process of making such conventional systems, the solder pads, such as shown at 40 and 42, are typically tinned with solder. Then the solid copper wire 21 is cut to form segments of desired length, placed on and soldered to solder pads 40, 42. Next the insulating sleeves 31, 33 are cut and strategically placed over the wire segments to prevent accidental short circuits. This conventional process is very time consuming, and reducing the time required to make an LED lighting strip is one of the advantages provided by embodiments of the present invention.

Each of the strips 22, 24 and 26 for example, may include a base or substrate, typically made of conventional polycarbonate or aluminum. Such a substrate is typically used when the LED strips are used in a panel, typically a flat panel. A substrate is not necessary, however, and the LED strips may simply be provided in separate strands to dangle freely, so long as they are electrically connected. Alternative substrates may be used, and such alternate substrates can be of virtually any form, such as for example, a ball, a globe, or any of other geometric shapes. Regardless of the nature and form of the substrate used, the solid or stranded positive wires and negative wires are typically soldered to positive solder pads and to negative solder pads, respectively. Positively charged wires and negatively charged wires forming power input lead 34 are typically encased in insulating materials, for example, Teflon brand fluoropolymer sleeves.

While in the FIG. 1 embodiment the input lead 34 is shown connected to the left end of the center strip 24, the input lead may be connected to the strip 24 at approximately the middle of the center strip 24, in order to more uniformly distribute voltage along the lengths of each of and among each of the LED strips 22, 24 and 26.

Referring to FIG. 1, each of strips 22, 24 and 26 typically includes a conventional, multi-layered printed circuit board (PCB) or tape 36, 36, 36, and a plurality of exposed positive and negative copper pads, such as, for example, positively charged pad 40 and negatively charged pad 42.

Figure 1A:
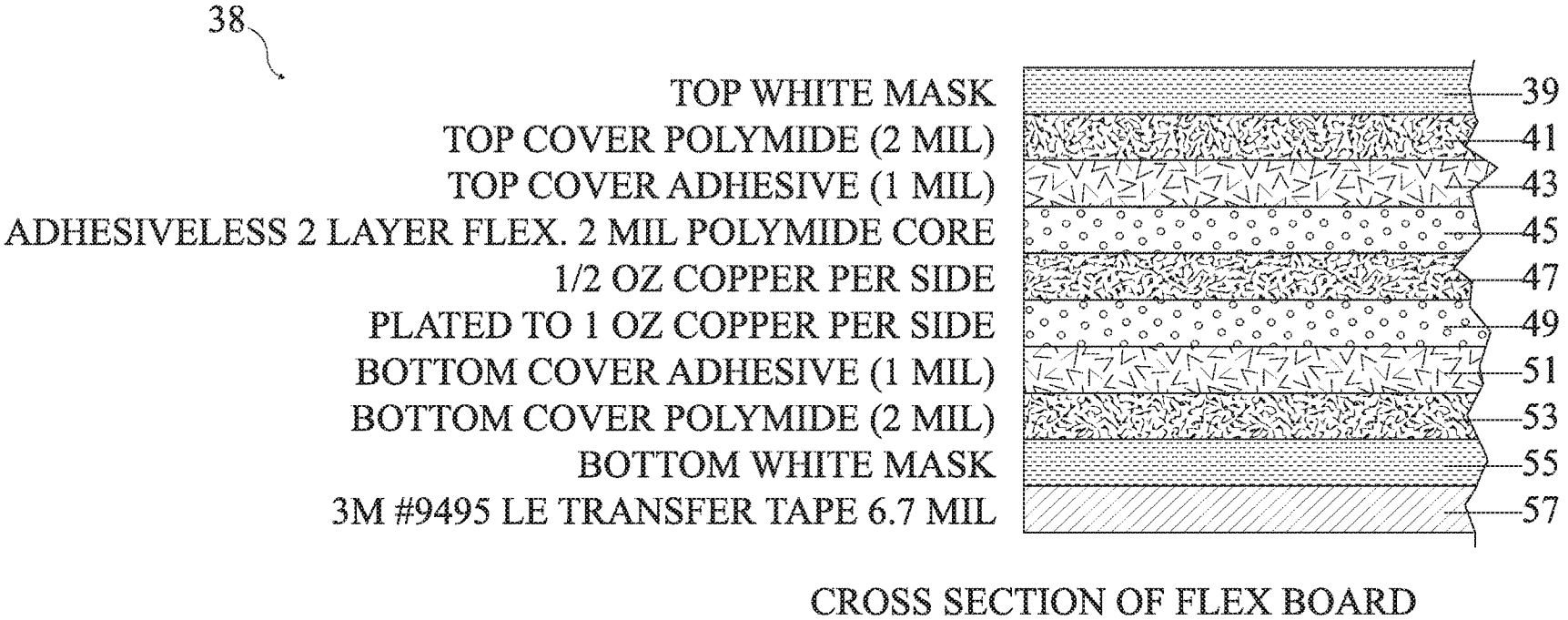
FIG. 1A is a cross-sectional view of a section of the FIG. 1 LED light source strip.

Referring to FIG. 1A, an exemplary the circuit board 38 typically includes a top, typically white colored mask 39, a 2 mil thick, polyimide top cover 41, a 1 mil thick top cover adhesive 43, an adhesiveless 2-layer, 2 mil thick polyimide core 47 that includes a 0.5 ounce copper layer 45 per side that is plated to a 1.0 ounce copper layer 49 per side. The layers of PCB 38 also typically include a 1 mil bottom cover adhesive 51, a 2 mil bottom cover polyimide 53, a bottom white mask 55 and a 6.7 mil thick transfer tape, typically 3M brand LE transfer tape #9495.

For one type of conventional, single color, nominal 12-volt LED strip having exposed copper pads, each group or set of three LEDs and its adjacent resistor are placed on the strip between exposed copper pads. As is well known, the width, length, number of rows, number of columns, resistor values and operating voltages may vary. For example conventional strips have widths of 8 mm, 10 mm, 16 mm, 25 mm and 100 mm; lengths of 0.5, 1.0, 2.0, 3.0 and 5.0 meters; 1, 2, 3, 4, 5 and 6 rows; resistor values of 470 Ohms, 560 Ohms, 680 Ohms, 820 Ohms, and 910 Ohms; and nominal voltages of 5 VDC, 12 VDC, 24 VDC and 48 VDC are well known. For making a single color, conventional, nominal 12-volt LED strip having copper pads for each of the positive and negative branches of the circuit, the copper pads are stacked on each other and placed on the strip after each group or set of three LEDs and adjacent resistor(s) (not shown) is/are placed on the strip between the exposed copper pads. As shown in FIG. 1, the pads 40 are in the positive branch of the circuit and pads 42 are in the negative branch of the circuit. FIG. 1 illustrates a panel having strips 22, 24 and 26 populated with LEDs of the same color, the input lead 34 is connected at one end of the panel and the individual strips are electrically connected to each other by the busses 30 and 32, as described above. Positive bus or bus sub-assembly 30 connects the positive coppers pads, which in the FIG. 1 embodiment are the positive pads 40, and negative bus or bus sub-assembly 32 connects the negative copper pads, which in the FIG. 1 embodiment are shown as negative pads 42. Solder pads are typically made of copper, but other electrically conducive materials may be used, such as gold. These conventional strips may be cut into segments, with, typically, a strip cut through at the solder pads, and the beginning and ending points of each of the segments located at these cuts at the solder pads. As is also well known, and described with reference to FIG. 1, the bussing of conventional LED strips takes place at the solder pads. As is also well known, the LEDs and colors emitted from the LEDs can vary, the number of strips can vary and an even number of strips may be used.

The typical insulation for the conventional, solid copper wiring is a plurality of Teflon brand fluoropolymer sleeves. Such Teflon brand sleeve insulation is shown as sleeves 31, 31 for the positive branch wiring and as sleeves 33, 33 for the negative conductor soldered to solder pads 42. This type of sleeve can be slid over solid copper. Other examples or types of insulation include non-electrically conductive tape (e.g., gaffer's tape, electrical tape), the insulation found on typical solid and stranded wire.

Negative bus sub-assembly 32 also preferably includes solid copper wire, shown at 23, Teflon brand sleeve insulation 33, 33 and with the wire 23 soldered to one of the negative solder pads 42. Two-conductor input power lead 34 includes positive conductor 44 and negative conductor 46, which are connected to and fed power by DC voltage power supply 28. Conductors 44 and 46 are typically soldered, or otherwise physically connected to solder pads 48 and 50, respectively, for the purposes of providing power to LED strip assembly 20. Three individual segments of LED strips 22, 24, and 26 are shown at 36, 36 and 36.

For the purpose of the presently disclosed invention(s), a "segment" of an LED strip is a piece of such strip bounded on either side or end by a "cut" or "cut points", as described above and as that term is understood in this field. Typically, during use, a cut would be made vertically, through and approximately in the middle between solder pads, such as through the middle of pads 40 and 42 (shown with a unnumbered, vertical line for each pad) in order to provide electrical points of contact or connections at each end of the strip segment. Once cut from the rest of the LED strip, a newly cut segment can be powered separately and function alone, that is, function independently of the rest of the strip from which it was cut. Typically, individual segments of an LED strip are connected in parallel to each of the other segments. While the FIG. 1 embodiment shows that power is brought in at the end of the middle strip, the selection of which solder pads to use, and where to connect the pads to the power depends on the requirements of the application, and can vary, as will be understood by those skilled in this field. Typically, the ideal location for such a power supply connection solder pad is somewhere in the center of the overall system, to mitigate the adverse effects of voltage line loss.

Figure 2:
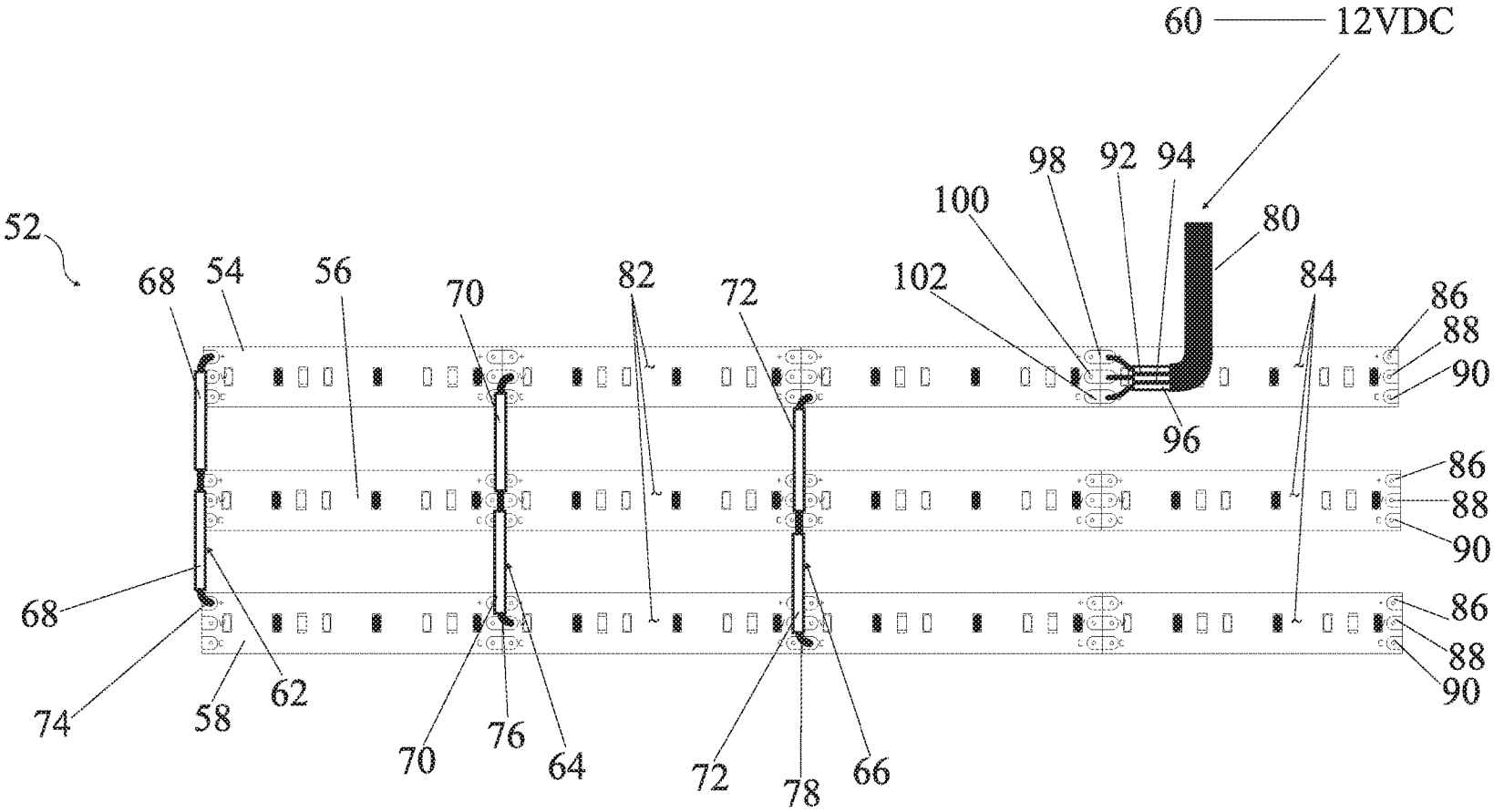
FIG. 2 is a top view of a conventional LED light source strip including three bicolor LED strips with conventional bussing.

Referring to FIG. 2, a conventional bicolor LED strip assembly 52 includes three bicolor LED strips 54, 56 and 58 that are bussed together with conventional bus sub-assemblies 62, 64 and 66. Input power is provided by external DC voltage power source 60, which in this example is 12 VDC. Power is provided through input power lead 80, with positive DC power conductor 92 soldered, or otherwise connected to positive solder pad 98, negative DC power conductor 94 (for the first color circuit) soldered (or otherwise connected) to negative solder pad 100 for the first color circuit, and negative DC power conductor 96 for the second color circuit soldered or otherwise connected to negative solder pad 102 for the second color circuit. [SG: appears that revisions to this part of FIG. 2 are needed. Bicolor strip 52 has other components and functions generally corresponding to the FIG. 1 strip, except as required to provide two colors. Referring to FIG. 2, the conventional assembly 52 includes first bicolor LED strip 54, second bicolor LED strip 56 and third bicolor LED strip 58. External DC voltage power source 60 is, for example, 12 VDC. The power source could be the same as used for the FIG. 1 embodiment. Positive bus assembly 68 typically includes solid copper wire 74 and pieces of Teflon brand insulation sleeve 68. The assembly is typically soldered, or may otherwise be connected to solder pads, such as solder pads, shown at 86, 86, 86.

Negative conductor 94 (for the first color circuit) from 3-conductor input power lead 80 is soldered to negative solder pad 100 to bring negative DC voltage to LED strip assembly 52. Negative conductor 96 (for the second color circuit) from 3-conductor input power lead 80 is soldered to negative solder pad 102 to bring negative DC voltage to LED strip assembly 52. Positive conductor 92 from 3-conductor input power lead 80 is soldered to positive solder pad 98 to bring positive DC voltage to LED strip assembly 52. Solder pad 98 enables positive DC voltage to be brought into the LED strip assembly 52. Negative solder pad 100 (for the first circuit color) enables negative DC voltage to be brought into the LED strip assembly 52. Negative solder pad 102 (for the second circuit color) enables negative DC voltage to be brought into the LED strip assembly 52.

Negative first color bus sub-assembly 64 includes solid copper wire 76, pieces of insulation 70, and solder pads, one of which is shown at 88 for each of the strips 54, 56 and 58. Negative second color bus sub-assembly 66 is for the second color circuit and includes solid copper wire 78, pieces of insulation 72, and solder pads 90 for each of strips 54, 56 and 58. Insulation 68 covers solid copper wire 74, insulation 70 covers wire 76 and insulation 72 covers wire 78. Typically, a piece of 18AWG solid copper 74 connects positive circuit solder pads 86 to each LED strip 54, 56 and 58. The conductor wire, typically solid copper wire 74 forms the basis or major component for bus sub-assembly 62 and connects the positive branch of the circuit. Electrically conductive material 76 is used for the negative part of the circuit for the first color and forms the basis or major component of bus sub-assembly 64. Electrically conductive material 78 is used for the negative part of the circuit for the second color and forms the basis or major component of bus sub-assembly 66. Input 12 VDC 60 provides power through three-conductor input power lead 80, which includes positive conductor 92, negative conductor 94 (for the first color circuit), and negative conductor 96 (for the second color circuit). Conductors 92, 94 and 96 [SG: the when FIG. 2 is converted from color to B&W, the lead lines for 92, 94 and 96 do not accurately show the locations—appears that the "black" color blots out the lead lines→please try to clarify] are soldered, or otherwise connected to solder pads 98, 100, and 102, respectively, for providing power to LED strip assembly 52. Also, as is known to those skilled in this field, an LED controller, also known as a "dimmer" may be included in circuit between the power supply and the assembly 52. The assembly 52 includes individual segments, shown at 82, 82, 82, and at 84, 84, 84 of LED strips 54, 56, and 58. Exemplary strips 54, 56 and 58 are as described previously for a single color system.

FIG. 2 also shows positive solder pads 86, negative solder pads 88 for the first color circuit, and negative solder pads 90 for the second color circuit. Positive conductor 92 supplies power from 12 VDC power supply 60 through three-conductor input power lead 80, which is soldered to positive solder pad 98 to bring positive DC voltage to LED strip assembly 52. Lead 80 is preferably connected at approximately the center of the strip and functions to uniformly distribute the current across the assembly or panel 52. In this exemplary embodiment an odd number of strips are used because the input lead can be connected to a "central" LED strip, to enable a more even distribution of voltage throughout the panel. Also, it is typical for each LED strip to have a common anode connection and dedicated cathode connections. A set of exposed copper pads is preferably equal in number to the number of colors plus 1. In this exemplary embodiment the width of each of these conventional strips is typically 12 mm. As shown in the FIG. 2 embodiment, with three conductors, the longitudinal centerlines of each of the three conductors are typically about 3 mm apart. During manufacturing of this type of conventional panel, problems associated with connecting the strips together via the busses have been known to occur, due primarily to the close proximity of the copper pads. For an example of such a problem, solder spilling onto an adjacent copper pad will result in a short circuit. If that short circuit is between a positive and a negative copper pad, then damage likely will result to any in-line dimmer and/or power supply that does not have short-circuit-protection. If the short circuit is between two negative copper pads, which can happen only in the case of multi-color strip panels, then the resulting emitted color will be a combination of the colors associated with the shorted pads.

Also, regarding the voltage line loss problem, for example, if several RGB LED strips are placed on the panel, bussed and the power supply is connected at one end of the panel, then the end of the panel opposite the power input end could have differently colored light emitted due to different voltages applied at the opposite ends of the panel as the result of voltage line loss. In relatively large panels, if the power supply is connected to an LED strip at one end of the panel, then that end of the panel would be much brighter than the opposite, remote end of the panel, due to voltage line loss. Similarly, if the power supply is connected to the middle part of the middle LED strip in a relatively large LED strip panel, then during operation the light output would be relatively more balanced across the length and width of the panel than if the power supply is connected at one of the ends of the panel. In some conventional applications, active current control using conventional controllers are known.

The LED strip panels as shown in the FIGS. 1 and 2 embodiments have three LED strips. Regardless of the number of strips, and whether an odd number or even number of strips is used in a specific assembly or array, preferably power is applied to the center of each strip for the purpose of load balancing. Other numbers of strips may be used, such as five, seven, etc., with a preference being use of an odd number of strips to facilitate efficient connections, and to balance the load among the strips, with a relatively even light output resulting. The light strips in an assembly are typically of the same color or same colors for the reason that a much more even output light results. For particular end uses, differently colored LED strips may be used. It is also typical to use LED strips that have the same electrical characteristics, such as electronic current control, voltage, typically 12 or 24 VDC and embedded microprocessor controls, if any.

Figure 3:
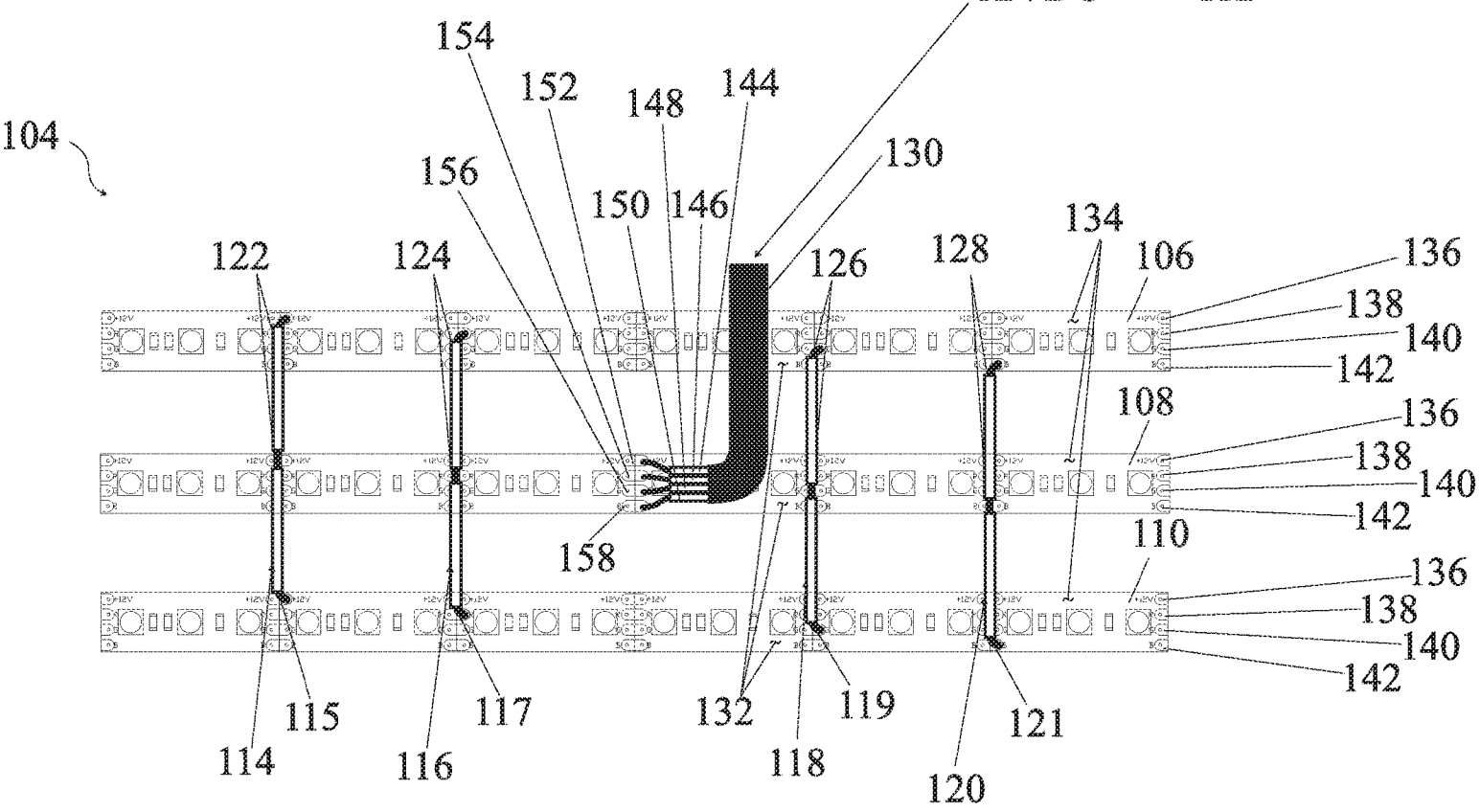
FIG. 3 is a top view of a conventional LED light source strip including three tricolor LED strips with conventional bussing.

Referring to FIG. 3, conventional LED strip assembly 104 includes three tricolor LED strips: first conventional tri-color strip 106; second conventional tri-color strip 108 and third conventional tri-color strip 110 that have been bussed together with bus sub-assemblies 114, 116, 118, and 120. Input power is provided by external DC voltage power source 112, in this example 12 VDC, through input power lead 130. Positive DC power conductor 144 is soldered or otherwise electrically connected to positive solder pad 152; negative DC power conductor 146 (for the first color circuit) is soldered or otherwise electrically connected to negative solder pad 154 (for the first color circuit), negative DC power conductor 148 (for the second color circuit) is soldered or otherwise electrically connected to negative solder pad 156 (for the second color circuit), and negative DC power conductor 150 (for the third color circuit) is soldered or otherwise connected to negative solder pad 158 (for the third color circuit).

Positive bus sub-assembly 114 includes solid copper wire 115 and pieces of conventional, Teflon brand sleeve 122. This sub-assembly is soldered or otherwise physically connected to solder pads, such as solder pads 136. In this embodiment a piece of 18AWG solid copper wire 115 connects positive circuit solder pads 136 to each LED strip 106, 108, and 110. Solid copper wire 115 forms the basis for bus sub-assembly 114. Negative bus sub-assembly 116 is for the first color circuit and preferably includes solid copper wire 117, pieces of insulation 124 and is soldered to solder pads 138. Negative bus sub-assembly 118 is for the second color circuit and includes solid copper wire 119, pieces of insulation 126 and is soldered to solder pads 140. Negative bus sub-assembly 118 is for the negative part of the circuit for the second color. Negative bus sub-assembly 120 is for the third color circuit and includes solid copper wire 121, pieces of insulation 128 and is soldered to solder pads 142. Wire 121 is for the negative part of the circuit for the third color and forms the basis of bus sub-assembly 120. Also referring to FIG. 3, insulation sleeves 122, 124, 126 and 128 cover and insulate copper wires 115, 117, 119 and 121, respectively. A 4-conductor input power lead 130 includes positive conductor 144, negative conductor 146 (for the first color circuit), negative conductor 148 (for the second color circuit), and negative conductor 150 (for the third color circuit). Power to the assembly 104 is supplied by DC voltage power supply 112, which in this exemplary embodiment is 12 VDC. Conductors 144, 146, 148, and 150 are soldered, or otherwise electrically and typically physically connected to solder pads 152, 154, 156, and 158, respectively, for providing power to LED strip assembly 104. Individual segments of LED strips 106, 108, and 110 are shown at 132, 132 and 132, and each strip typically includes a PCB board as shown at 134, 134 and 134 and described with reference to FIG. 1A. FIG. 3 also shows positive solder pad 136, negative solder pad 138 for the first color circuit, negative solder pad 140 for the second color circuit and negative solder pad 142 for the third color circuit.

Again referring to FIG. 3, positive conductor 144 from 4-conductor input power lead 130 is soldered to positive solder pad 152 to bring positive DC voltage to LED strip assembly 104. Negative conductor 146 (for the first color circuit) from 4-conductor input power lead 130 is soldered to negative solder pad 154 to bring negative DC voltage to LED strip assembly 104. Negative conductor 148 (for the second color circuit) from 4-conductor input power lead 130 is soldered to negative solder pad 156 to bring negative DC voltage to LED strip assembly 104. Negative conductor 150 (for the third color circuit) from 4-conductor input power lead 130 is soldered to negative solder pad 158 to bring negative DC voltage to LED strip assembly 104. Positive solder pad 152 supplies positive DC voltage to the LED strip assembly 104 through positive input contact 144 of lead 130. Negative solder pad 154 (for the first circuit color) is where negative DC voltage is brought into the LED strip assembly 104. Negative solder pad 156 (for the second circuit color) is where negative DC voltage is brought into the LED strip assembly 104. Negative solder pad 158 (for the third circuit color) is where negative DC voltage is brought into the LED strip assembly 104. For all intents and purposes, the solder pads and conductors shown in FIG. 3 are the same as the solder pads and conductors previously described with respect to FIGS. 1 and 2, except that they correspond to different and additional colors and their related circuits and sub-assemblies.

Figure 4:
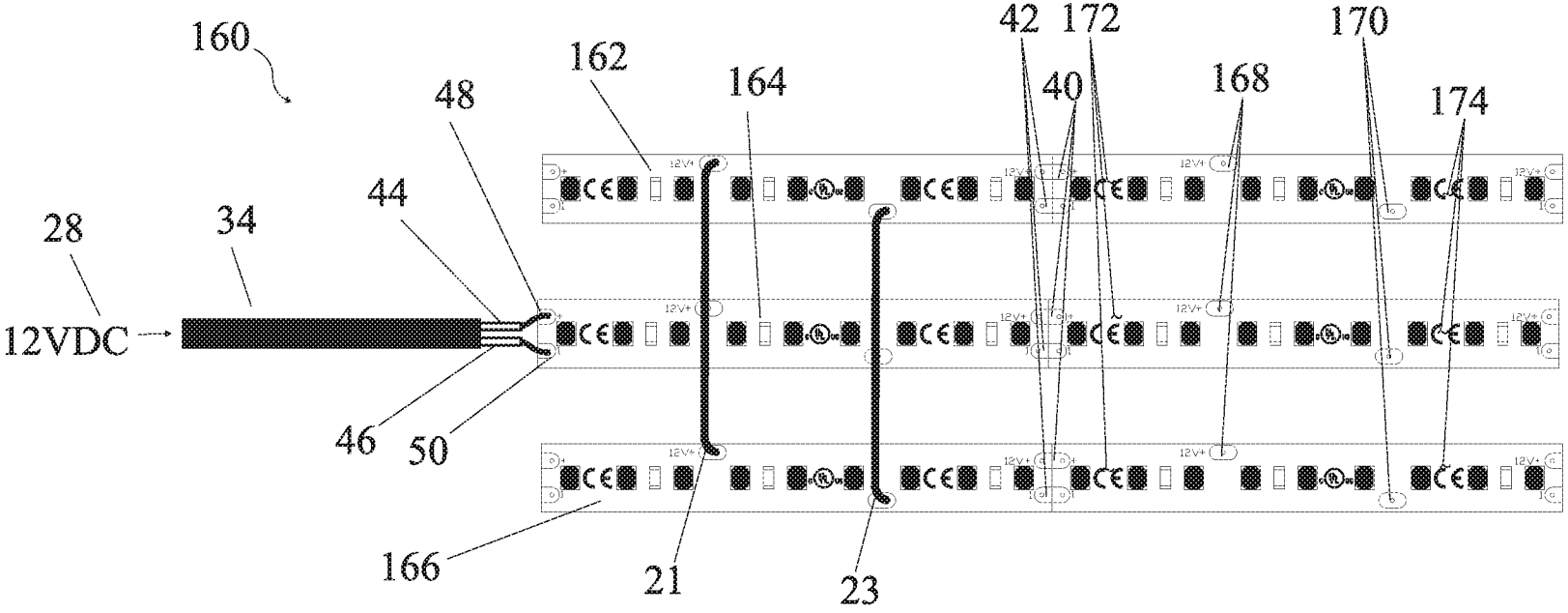
FIG. 4 is a top view of a preferred embodiment LED light source strip including three single color LED strips.

Referring to FIG. 4, a preferred embodiment LED strip assembly 160 includes three (3) single color LED strips 162, 164, and 166 that are bussed together with positive copper wire 21 and negative copper wire 23 in accordance with the principles of the present invention. The LEDs used in strips 162, 164 and 166 may emit the same color or may emit different colors of light. Input power is supplied by external DC voltage power source 28, which in the FIG. 4 embodiment is 12 VDC, and through input power lead 34. Positive DC power conductor 44 is soldered, and may be otherwise electrically connected to positive solder pad 48. Negative DC power conductor 46 is soldered, and may be otherwise electrically connected to negative solder pad 50. While many of the components of assembly 160 are of the same type and construction as those shown in the FIG. 1 conventional assembly, the FIG. 4 embodiment illustrates novel features of the present invention and includes single color LED strip 162, single color LED strip 164 and single color LED strip 166. Isolated positive solder pads 168 and isolated negative solder pads 170 are placed or positioned at various points or locations along the length of each strip. Use of such isolated solder pads and their positioning function to reduce or to minimize the chance or probability of a short circuit occurring between the positive and negative branches of the assembly circuit. With such isolated solder pads, there is no longer a need to insulate or otherwise protect uninsulated copper wires 21 and 23, because in this configuration the wires cannot make inadvertent contact with a solder pad of an oppositely charged circuit. In other words, a positive bus cannot accidentally contact or hit a negative solder pad or a negative bus and cause a short circuit.

As shown in FIG. 4, isolated positive solder pads 168, 168, 168 are identical to the FIG. 1 solder pads 40, but pads 168 are isolated, that is, are remote from and no longer have an adjacent solder pad, such as pads 42 in conventional assemblies, as shown in FIG. 1. Because solder pads 168 no longer have any adjacent solder pad(s), the chance/probability that the positive branch of the assembly circuit could make contact with the negative branch of the assembly circuit is greatly minimized, thereby greatly minimizing the chance of a short circuit and increasing the overall safety for personnel and equipment.

The process of making a bussed LED light assembly as shown and described with reference to FIG. 4 also results in greatly increased manufacturing workflow advantages for several reasons. The time necessary to prepare an LED strip assembly incorporating the principles illustrated by assembly 160 is greatly reduced compared to the time necessary to prepare a conventional LED strip assembly 20 of FIG. 1. In accordance with the principles of the present invention, LED strip assembly 160 does not have any of the bus sub-assemblies as shown in FIG. 1 as bus sub-assemblies 30 and 32. These conventional bus sub-assemblies have been wholly replaced by uninsulated copper wires 21 and 23, respectively. Also, insulating materials 31 and 33 have been eliminated because they are no longer needed to prevent accidental short circuits. Significant manufacturing workflow improvement also results from the present bussing sub-assemblies because the process of incorporating such insulating materials 31 and 33 is one of the more time-consuming aspects of making an LED strip assembly, such as the FIG. 1 LED strip assembly 20. Also, the technical skill level needed to make a FIG. 4 LED strip assembly 160, as compared to the technical skill level needed to make a FIG. 1 LED strip assembly 20 is much lower because the soldering tasks are not as complex, and fewer materials are needed to make a complete light assembly. Thus, labor costs associated with the preparation of an LED strip assembly such as assembly 160 are significantly less than labor costs needed to make conventional strip assemblies as shown, for example, in FIGS. 1, 2 and 3. Also, because fewer materials of construction are needed, and the cost of materials is much less for making an assembly as shown in FIG. 4 as compared to the materials and cost of materials needed for making an assembly as shown in FIGS. 1, 2 and 3. Also shown in FIG. 4 are isolated negative solder pads 170, 170, 170. Solder pad 170 corresponds to solder pad 42 shown in FIG. 1, but the FIG. 4 assembly no longer has an adjacent solder pad, such as pad 40 shown in FIG. 1. Individual segments 172, 172, 172 and 174, 174, 174 of LED strips 162, 164, and 166 are also shown in FIG. 4.

Figure 5:
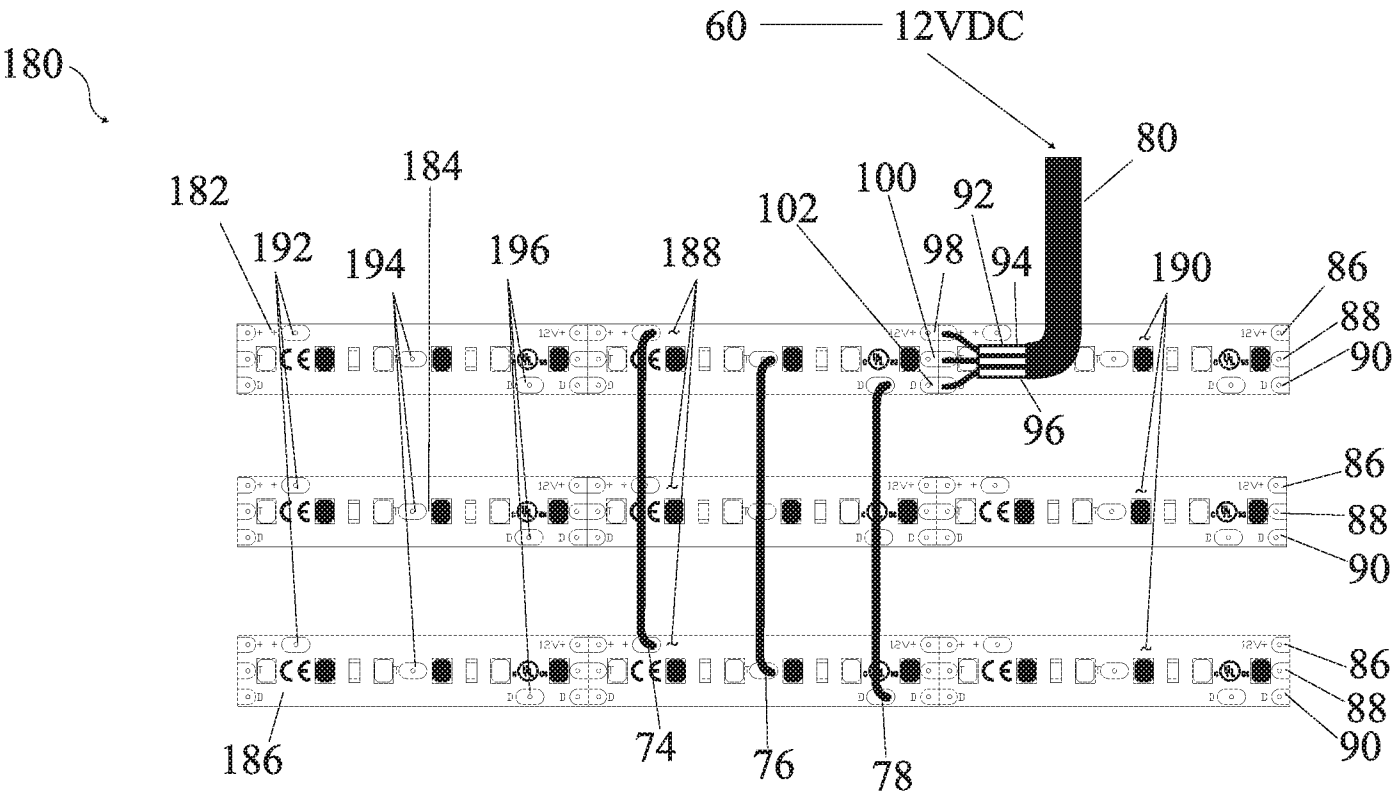
FIG. 5 is a top view of an alternate preferred embodiment LED light source strip including three bicolor LED strips; and, FIG. 6 is a top view of an alternate preferred embodiment LED light source strip that includes three tricolor LED strips.

Referring to FIG. 5, LED strip assembly 180 includes three (3) bicolor color LED strips 182, 184, and 186 that have been "bussed" together in accordance with principles of the present invention. Positive copper wire 74, negative copper wire 76 (for the first color circuit), and negative copper wire 78 (for the second color circuit) are powered by external 12 VDC power source 60. Input power lead 80 includes positive DC power conductor 92 that is soldered or otherwise electrically connected to positive solder pad 98, negative DC power conductor 94 (for the first color circuit) that is soldered or otherwise electrically connected to negative solder pad 100 (for the first color circuit), and negative DC power conductor 96 (for the second color circuit) that is soldered or otherwise electrically physically connected to negative solder pad 102 (for the second color circuit).

The FIG. 5 bicolor LED strip assembly 180 includes isolated positive solder pads 192, 192, 192 and isolated negative solder pads 194, 194, 194 (for the first color circuit), and isolated negative solder pads 196, 196, 196 (for the second color circuit). These pads are located or positioned at various points along the length of each strip and function, in part, to prevent a short circuit from occurring between positive and negative branches of the assembly circuit, and to prevent a short from occurring between different negative branches of the assembly circuit. With isolated solder pads, no need to insulate or otherwise protect the uninsulated copper wires 74, 76, and 78 exists. This is because these wires cannot make inadvertent contact with a solder pad of an oppositely charged circuit or with two negative conductive elements from different branches. In other words, a positive bus conductive component cannot accidentally hit or come in contact with a negative solder pad, a negative bus, or a conductive negative bus component; and two negative conductive elements from different branches cannot come into contact with each other.

Assembly 180 includes second bicolor LED strip 184 and third bicolor LED strip 186. The strips include individual segments 188, 188, 188 and 190, 190, 190 as described above with reference to conventional LED strips. Isolated positive solder pad 192, 192, 192 are also shown in FIG. 5. Unlike the isolated solder pads 168 and solder pads 40 as shown in FIG. 4, isolated solder pads 192 are not identical to solder pad 86 as shown in FIG. 5, even though they are both part of the positive circuit. Specifically, whereas solder pads 86 can be cut through or severed without damaging the circuit in an individual segment, such as individual segment 188, cutting through or severing any, some or all of solder pads 192, 192, 192 will damage the respective circuit(s). However, due to the greater number of solder pads (pads 86, 88, 90) provided on the FIG. 5 embodiment strips, such as strip 186 for example, even if some damage results from some cutting, the FIG. 5 embodiment assembly provides advantages in comparison to the FIG. 4 embodiment. The FIG. 5 embodiment provides several advantages, such as that the FIG. 5 design minimizes waste. As segments are cut from a larger, or master strip, it is advantageous and more convenient to have a complete set of solder pads (e.g., solder pads 86, 88, and 90) at the end of the strip and, in addition to have the isolated solder pads (e.g., isolated solder pads shown at 192, 192, 192, 194, 194, 194, 196, 196 and 196) on individual segments (e.g., individual segments 188, 188, 188). As is known to those skilled in this field, bussing of LED strips is only one example of the ways in which LED strips can be used.

For an example of increased convenience due to the multiple, differently positioned solder pads, when such a strip is mounted on an aluminum channel and not bussed, it is typically easier to supply power through a power input lead, such as power input lead 80, that is connected to an end of the LED strip, such as LED strip 182. This is because most commercially available aluminum channels include plastic or metal end caps that have openings for input leads.

Connecting an input lead to solder pads that are not on one end of the LED strip, such as the isolated solder pads 192, 194, and 196, such as shown in the FIG. 5 embodiment, would be considerably more difficult and would be inconvenient in comparison to connecting an input lead to an end of the LED strip. Also, the other advantages associated with LED light strips having isolated solder pads still applies for assemblies having both isolated pads positioned intermediate to the ends of the strips, as well as pads positioned at the beginnings and at the ends of the strips, as shown in FIG. 5.

As will be appreciated by those skilled in this field, isolated negative solder pads, such as solder pads 194, 194, 194 are unlike isolated solder pads 168 and unlike solder pads 40 shown in FIG. 4. Isolated solder pads 194, 194, 194 are not identical to solder pad 88, 88, 88 shown in FIGS. 2 and 5, even though they are both part of the negative first color circuit. The isolated negative solder pads provide the same advantages and benefits as do the isolated solder pads described above.

As will also be appreciated by those skilled in this field, isolated negative solder pads 196 are unlike isolated solder pads 168 and 40 of FIG. 4. Also, isolated solder pads 196 are not identical to solder pads 90 as shown in FIG. 5, even though they are of the negative second color circuit.

Figure 6:
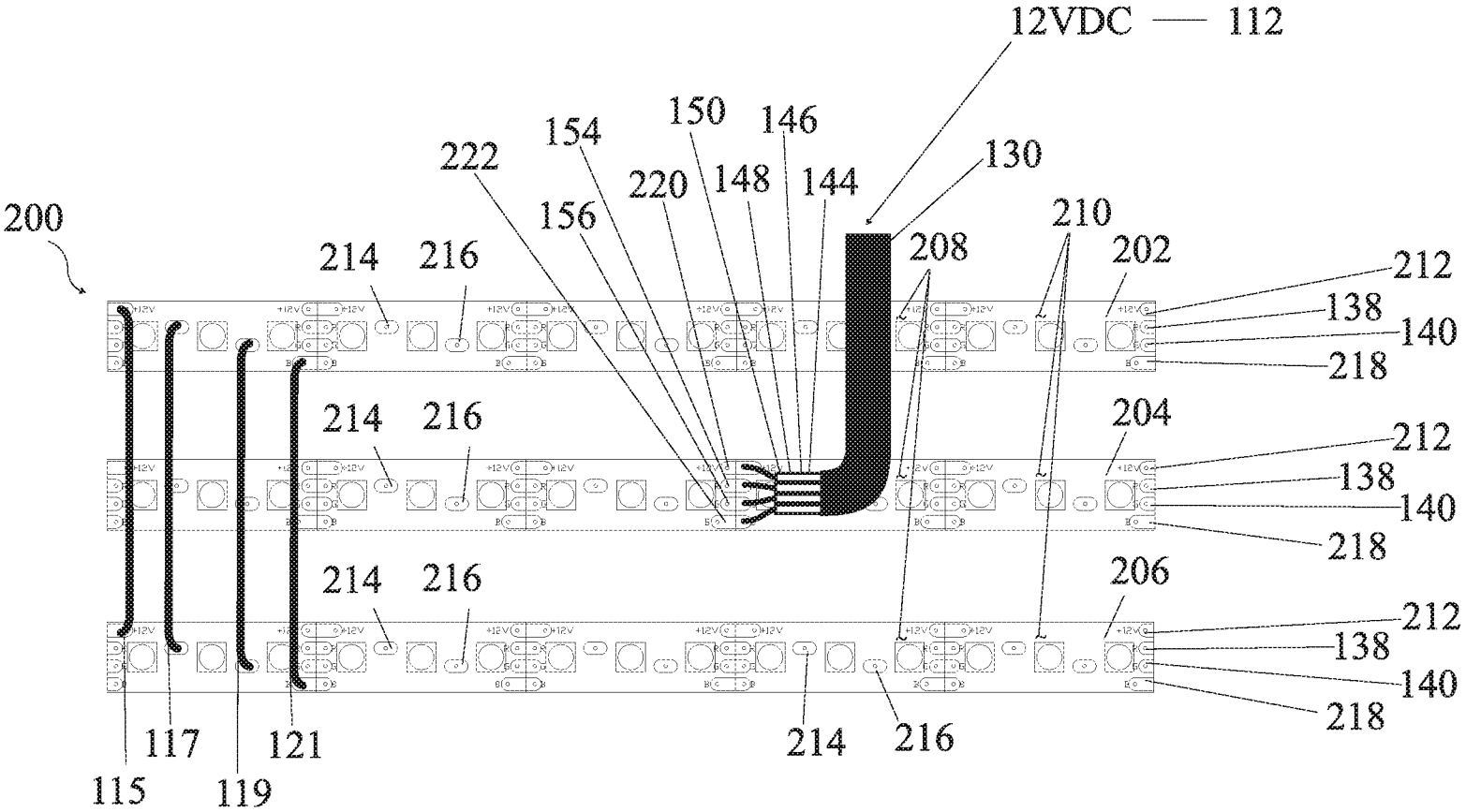

With reference to FIG. 6, an alternate embodiment LED strip assembly 200 includes three (3) tricolor color LED strips 202, 204, and 206 that have been bussed together with positive copper wire 115, negative copper wire 117 (for the first color circuit), negative copper wire 119 (for the second color circuit), and negative copper wire 121 (for the third color circuit) with input power being provided by external 12 VDC voltage power source 112. Power is supplied through input power lead 130 with positive DC power conductor 144 soldered or otherwise electrically, typically physically connected to positive solder pad 220, negative DC power conductor 146 (for the first color circuit) being soldered or otherwise electrically connected to negative solder pad 154 (for the first color circuit), negative DC power conductor 148 (for the second color circuit) being soldered or otherwise electrically connected to negative solder pad 156 (for the second color circuit), and negative DC power conductor 150 for the third color circuit being soldered or otherwise electrically connected to negative solder pad 222 (for the third color circuit).

Extended positive solder pads 212, isolated negative solder pads 214 (for the first color circuit), isolated negative solder pads 216 (for the second color circuit), and extended negative solder pads 218 (for the third color circuit) are located at various points or positions along the length of the strips and at the ends of the strips in order to minimize the chance or probability of a short circuit occurring between positive and negative branches of the assembly circuit. With extended, end pads and isolated solder pads, there is no need to insulate otherwise protect the uninsulated copper wires 115, 117, 119, and 121, because they are considerably less likely to or cannot make inadvertent contact with a solder pad of an oppositely charged part or branch of the assembly circuit, e.g., a positive bus cannot accidently hit a negative solder pad or a negative bus. FIG. 6 also shows individual segments 208, 208, 208 and individual segments 210, 210, 210 of LED strips 202, 204, and 206. Extended positive solder pads 212, 212, 212 are shown in FIG. 6 and function as described above. Unlike isolated solder pads 214 and 216, extended or end solder pads 212 may be slightly more exposed to the risks of conventional bussing. In some situations, however, extended solder pads are the only viable design option or are preferable as compared to isolated solder pads. One such situation is when many components must be placed on the LED strip(s), components such as LEDs and resistors, which limit the amount or area of free space remaining for placement of isolated solder pads. Extended, end solder pads, however, have a portion—often a significant portion—of the pad that is not physically next to any other pads, thereby making extended solder pads viable in some situations. As will be appreciated by those skilled in this field, sold pads 212, like solder pads 168 and 170, may be cut through or severed without damaging the individual segment. All of the advantages and benefits as described above with reference to the FIGS. 4 and 5 embodiment isolated solder pads apply to the FIG. 6 embodiment isolated positive solder pads, assemblies, systems and processes.

As will be appreciated by those skilled in this field, unlike the isolated solder pads 168 and solder pads 40, isolated solder pad 214 is not identical to solder pad 138, despite the fact that they are all part of the negative first color circuit. Similarly, as will be appreciated by those skilled in this field, unlike isolated solder pads 168 and solder pads 40, isolated solder pad 216 is not identical to solder pad 140, despite the fact that they are both part of the negative second color circuit. As also shown in FIG. 6, positive DC voltage is brought into the LED strip assembly 200 at and through positive solder pad 220. As will be appreciated by those skilled in this field, solder pad 220 functions as does solder pad 212. Negative DC voltage is supplied to the strip through solder pad 222 (for the third circuit color).

In accordance with the above description it will be apparent to those skilled in this field that numerous advantages flow from and are enabled by the presently described inventions. First, safety is improved with use of the present inventions because the likelihood of creating short circuits is greatly reduced. The likelihood of fewer short circuits created with use of the present inventions is directly proportional to the reduced number of soldered connections made in the present inventions as compared to a much greater number of soldered connections made with conventional LED panel manufacturing processes. Second, the amount of and cost of materials needed for the presently described inventions is greatly reduced in comparison to the amount and cost of materials needed for the conventional LED panel manufacturing processes. In typical conventional processes, separate solid copper wire and relatively expensive Teflon brand sleeves are required. Stranded copper wire could also be used in the conventional processes, but a very time consuming and error-prone "looping" process would be used. In comparison, the presently described inventions require, for example, only common stranded copper wire, copper tape and/or electrically conductive ink. Other relatively inexpensive materials, as will be known to those skilled in this field, can be used in the presently described invention. Third, the amount of labor required to solder the connections in the conventional processes is much greater than the amount of labor required for the presently described inventions. Much of the labor cost associated with the typical conventional processes is for tedious preparation and application of the solid copper wire and Teflon sleeves (the tubular covering) for the electrical connections, which is the bussing as described above. Thus, the time and cost to manufacture such LED strips is significantly reduced. Fourth, the technical skill level of personnel who make the LED panels and who use the LED panels of the present invention can be much lower than the level of skill needed to make and use the conventional LED panels.

Although specific embodiments of the disclosure have been described, various modifications, alterations, alternative constructions, and equivalents are also encompassed within the scope of invention as set forth in the claims.

The specification and drawings are, accordingly, to be regarded in an illustrative rather than a restrictive sense. It will, however, be evident that additions, subtractions, deletions, and other modifications and changes may be made thereunto without departing from the broader spirit and scope of invention as set forth in the claims.

What is claimed is:

1. An LED light panel bus system comprising:

a first, single color LED strip;

a second, single color LED strip;

a third, single color LED strip;

the first, second and third single color LED strips bussed together with a positive wire and a negative wire;

an external DC voltage power source adapted to supply electrical power to the first, second and third LED strips;

isolated positive solder pads positioned at predetermined positions along the length of the first single color LED strip;

isolated positive solder pads positioned at predetermined positions along the length of the second single color LED strip;

isolated positive solder pads positioned at predetermined positions along the length of the third single color LED strip;

isolated negative solder pads positioned at predetermined positions along the length of the first single color LED strip;

isolated negative solder pads positioned at predetermined positions along the length of the second single color LED strip;

isolated negative solder pads positioned at predetermined positions along the length of the third single color LED strip; and, an uninsulated copper wire electrically connecting the first single color LED strip, second single color LED strip, and the third single color LED strip, each to the other.

2. The system of claim 1, wherein the uninsulated copper wire is a first uninsulated copper wire electrically connecting the isolated positive solder pads of the first single color LED strip, second single color LED strip, and the third single color LED strip, each to the other; and further comprising:

a second uninsulated copper wire electrically connecting the isolated negative solder pads of the first single color LED strip, second single color LED strip, and the third single color LED strip, each to the other.

3. The system of claim 2, wherein:

the first uninsulated copper wire is electrically connecting together in parallel the isolated positive solder pads of the first single color LED strip, the second single color LED strip, and the third single color LED strip; and the second uninsulated copper wire is electrically connecting together in parallel the isolated negative solder pads of the first single color LED strip, the second single color LED strip, and the third single color LED strip.

4. The system of claim 3, wherein:

the predetermined positions of the isolated positive solder pads positioned along the length of the first, second and third single color LED strips are remote from the predetermined positions of the isolated negative solder pads positioned along the length of the first, second and third single color LED strips.

5. An LED light panel bus system comprising:

a first, single color LED strip;

the first, single color LED strip including an electrical circuit having a positive branch and a negative branch;

a second, single color LED strip;

the second, single color LED strip including an electrical circuit having a positive branch and a negative branch;

the first and second single color LED strips bussed together with a positive wire and a negative wire;

an external DC voltage power source adapted to supply electrical power to the first and second LED strips;

isolated positive solder pads positioned at predetermined positions along the length of the first single color LED strip;

isolated positive solder pads positioned at predetermined positions along the length of the second single color LED strip;

isolated negative solder pads positioned at predetermined positions along the length of the first single color LED strip;

isolated negative solder pads positioned at predetermined positions along the length of the second single color LED strip;

electrically conductive material connecting the positive branch of the first single color LED strip circuit to the positive branch of the second single color LED strip circuit; and, electrically conductive material connecting the negative branch of the first single color LED strip circuit to the negative branch of the second single color LED strip circuit.

6. The system of claim 5, wherein the electrically conductive material connecting the positive branch of the first single color LED strip circuit to the positive branch of the second single color LED strip circuit is a positive uninsulated wire electrically connecting in parallel the positive branch of the first single color LED strip circuit to the positive branch of the second single color LED strip circuit; and wherein the electrically conductive material connecting the negative branch of the first single color LED strip circuit to the negative branch of the second single color LED strip circuit is a negative uninsulated wire electrically connecting in parallel the negative branch of the first single color LED strip circuit to the negative branch of the second single color LED strip circuit.

7. The system of claim 5, further comprising:

a third, single color LED strip including an electrical circuit having a positive branch having isolated positive solder pads and a negative branch having isolated negative solder pads;

isolated positive solder pads positioned at predetermined positions along the length of the of the third single color LED strip;

isolated negative solder pads positioned at predetermined positions along the length of the of the third single color LED strip;

the electrically conductive material connecting the positive branch of the first single color LED strip circuit to the positive branch of the second single color LED strip circuit is also connected to the positive branch of the third single color LED strip circuit; and the electrically conductive material connecting the negative branch of the first single color LED strip circuit to the negative branch of the second single color LED strip circuit is also connected to the negative branch of the third single color LED strip circuit.

8. The system of claim 5, wherein the electrically conductive material connecting the positive branch of the first, second and third single color LED strip circuits is a positive uninsulated wire electrically connecting in parallel the positive branch of the first, second and third single color LED strip circuits; and wherein the electrically conductive material connecting the negative branch of the first, second and third single color LED strip circuits is a negative uninsulated wire electrically connecting in parallel the negative branch of the first, second and third single color LED strip circuits.

* * * * *